United States Patent [19]

Medel

[11] Patent Number: 4,602,464

[45] Date of Patent: Jul. 29, 1986

[54] RESIDENTIAL BUILDING

[76] Inventor: Theo Medel, Mozartstrasse 50, D-7229 Baiersbronn, Fed. Rep. of Germany

[21] Appl. No.: 592,909

[22] Filed: Mar. 23, 1984

[30] Foreign Application Priority Data

Mar. 31, 1983 [DE] Fed. Rep. of Germany ..... 3311783

[51] Int. Cl.[4] ..... E04B 1/34; E04H 1/00

[52] U.S. Cl. ..... 52/236.4; 52/185; 52/234

[58] Field of Search ..... 52/79.2, 79.3, 79.4, 52/79.7, 79.8, 234, 236.1, 236.3, 236.4, 185

[56] References Cited

U.S. PATENT DOCUMENTS

| | | | |
|---|---|---|---|
| 3,513,607 | 5/1970 | Renes . | |
| 3,566,558 | 3/1971 | Fisher . | |
| 3,629,983 | 12/1971 | Jenn | 52/79.3 X |
| 3,656,266 | 4/1972 | Tylius | 52/236.4 X |
| 3,724,143 | 4/1973 | Paukulis | 52/79.2 |
| 3,805,461 | 4/1974 | Jagoda | 52/79.2 X |
| 4,035,973 | 7/1977 | Sutelan | 52/236.4 X |

FOREIGN PATENT DOCUMENTS

| | | | |
|---|---|---|---|
| 105083 | 8/1966 | Denmark | 52/79.3 |
| 1362990 | 8/1974 | United Kingdom | 52/79.3 |

OTHER PUBLICATIONS

"Journal of Homebuilding", Apr., 1968, p. 76.

Sonnenenergie für Haus und Schwimmbad Udo Pfrimer Verlag—1981—pp. 78-79.

Schweizer Ingenieur und Architeki Wohnbauten—p. 57.

*Primary Examiner*—John E. Murtagh

*Assistant Examiner*—Richard E. Chilcot, Jr.

*Attorney, Agent, or Firm*—Balogh, Osann, Kramer, Dvorak, Genova & Traub

[57] ABSTRACT

A residential building, particularly a residential building having a timber skeleton, is described, which has walls that extend at right angles to each other and are arranged in accordance with a square-field grid plan having a grid line spacing A. That housing embodies the following features:

(a) A cell is defined, which has a plan form of a square having a side length 2A;

(b) the residential building has in a plan view three parallel axes, which extend outside the cell and two of which are aligned with two mutually opposite sides of the cell; one of said two axes extends beyond at least one of the two other sides of the cell, which extend at right angles to said axes; the third of said axes extends from the center of the other of the two sides of the cell which extend at right angles to said axes;

(c) load-carrying means are provided on said axes at least at part of the grid line intersections;

(d) a ceiling structure of the building consists of sections which are vertically offset along two of said three axes; one of said last-mentioned two axes is the axis that extends from the center of one side of the cell.

20 Claims, 7 Drawing Figures

RESIDENTIAL BUILDING

Figure 1:
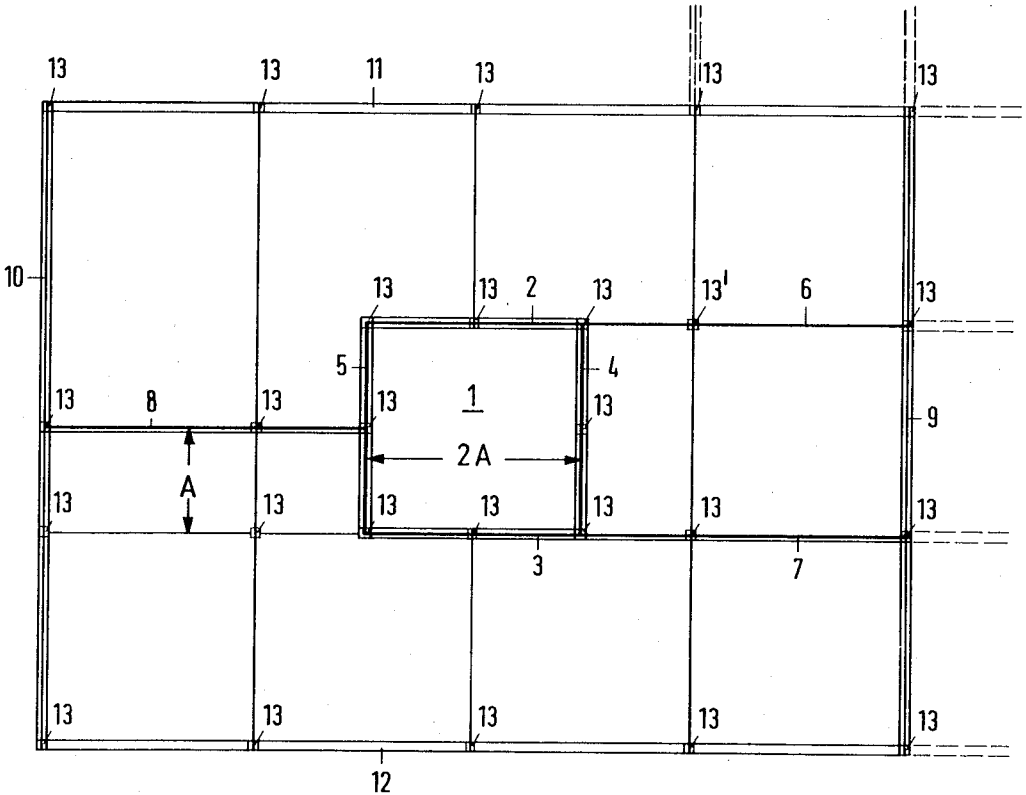

This invention relates to residential buildings, particularly of residential buildings having a timber skeleton. It is already known to provide residential buildings which in a plan view are designed in accordance with a square-field grid-plan in which the walls and any posts for supporting upper floors are spaced apart by one grid line spacing or an integral multiple of such grid line spacing. That design results in standardized dimensions, which are favorable for efficient methods of construction. But the standardized dimensions involve the disadvantage that they restrict the possibility of varying the design of residential buildings so as to suit individual requirements or desires and that such buildings cannot be erected on any desired plot.

It is an object of the invention to provide an improvement in this respect by the provision of a novel residential building which uses standardized dimensions and yet can be rather closely adapted to the requirements imposed by the owner of the building and by the plot.

In a residential building, particularly a residential building having a timber skeleton, which building has walls that extend at right angles to each other and are arranged in accordance with a square-field grid plan having a grid line spacing A, that object is accomplished by the combination of the following features:

(a) A cell is defined, which has a plan form of a square having a side length 2A;

(b) the residential building has in a plan view three parallel axes, which extend outside the cell and two of which coincide with two mutually opposite sides of the cell; one of said two axes extends beyond at least one of the two other sides of the cell, which extend at right angles to said one axis, the third of said axes extends from the center of the other of the two sides of the cell which extend at right angles to said axes;

(c) load-carrying means are provides on said axes at least at part of the grid line intersections;

(d) a ceiling structure of the building consists of sections which are vertically offset along two of said three axes; one of said last-mentioned two axes is the axis which extends from the center of one side of the cell.

Advantageous further improvements are recited in the dependent claims.

An import feature of the invention is the provision of a square cell in each story. That cell is the origin of the three axes which are apparent in a plan view. The main loads of the building are taken up and applied to the ground by the outer walls of the building and by those walls or posts which define the sides of the cell and the axes extending from said cell. The cell and the three axes may be provided in the building in a plan view only once or, in a building having numerous apartments on each floor, may be provided two or more times. In that case, adjacent cells should not be contiguous and the axes which extend from one cell are preferably, but need not be, parallel to the axes extending from the other cell or cells.

In dependence on the grid plan which has been adopted, individual rooms or apartments having different sizes and different plan forms can be arranged around the square cell, provided that such rooms or apartments conform to the grid plan which has been adopted. In a residential building having given external dimensions, the basic pattern provided by the invention may be used for widely varying plan forms. An even greater variation will be permitted if the external dimensions of the building are also varied whereas the basic pattern is retained. Residential buildings having any desired base area may be obtained by arranging a plurality of sections having plan forms conforming to the basic pattern according to the invention.

Whereas the sides of the square cell and the three axes extending from said cell need not be defined by solid walls, it is necessary to provide load-carrying means, such as walls or posts, on said sides and axes at least at part of the grid line intersections. If walls are used, such posts may be integrated in the walls or the walls may replace the posts. In a building having a timber skeleton, to which the invention is applicable to special advantage, the posts should always be separate elements. The posts disposed on an axis should be spaced apart by no more than twice the grid line spacing. Posts which are spaced from the axes and the square cell may be spaced once of twice the grid line spacing. Posts which are spaced from the axes and the square cell may be spaced apart by one grid line spacing or by twice or three times the grid line spacing whereas a larger spacing is suitably avoided. Any posts provided on the sides of the square cell preferably spaced apart by one grid line spacing, so that a total of eight posts are provided on the sides of the cell.

Another essential feature of the invention is the fact that each upper floor consists of floor sections which are vertically offset along that axis which extends form the center of one side of the cell and along another of said three axes. That offset is beneficial from several aspects:

In a building having a timber skeleton, the horizontal timbers connecting the posts can have only a limited length. It is usually necessary to provide horizontal timbers which extend throughout the length or throughout the width of the building. If each upper floor consists of vertically spaced apart sections, as is taught by the invention, those horizontal timbers which extend at right angles to the axes may terminate at those two axes along which the floor is offset because the horizontal timbers which extend to the step wall structure connecting the offset sections are disposed on disposed on different levels owing to the offset so that said horizontal timbers can easily be anchored in a mutually overlapping manner on the posts disposed on said two axes. This would not be possible without the offset.

The roof may also comprise sections which are offset like the sections of the upper floors. The use of a roof having vertically offset sections affords a further advantage because the vertical step walls between vertically offset roof sections may be provided with windows through which the rooms behind said walls can be supplied with light and air. In such vertical step walls, windows may be installed more easily than in the roof itself because owing to the sealing problems, windows in a roof must either be fixed, which means that the window cannot be opened, or must be provided with frames having intricate and often unsightly sectional shapes. Besides, windows in a roof have an unfavorable orientation relative to the sun. Unless the windows in a roof are provided in steep roof surfaces facing south, they will result in an incidence of a large quantity of light and in a considerable heating of the building in summer, when the weather is bright and warm anyway, whereas in winter, when an incidence of additional light would be particularly desirable, only a small quantity of light will be incident from the sun, which is low in the sky.

On the other hand, if a residential building in accordance with the invention is erected with such an orientation that the windows provided in the step wall face approximately south, optimum conditions will be obtained regardless of the shape which has been selected for the roof. In that case, the smallest quantity of light will be incident on the vertical windows in summer so that the heating effect will be small too and can be reduced further in that the windows are opened (tilted). In winter, the largest quantity of light will be incident on the vertical windows and the sunlight will considerably contribute to the heating of the building. In that case, a special advantage afforded by the offset roof will reside in that the light and radiant heat can directly enter the rear rooms of the building. In a residential building having no such offset roof, the light and radiant heat from the sun passing through glazed areas of a facade facing south or a glass house (winter garden) in front of a facade facing south can reach only the rooms on the south side but cannot reach in the rear rooms.

A further advantage afforded by the offset resides in that a very good access to a plurality, up to four, apparts- ments provided around the stair well will be ensured in buildings in which the square cell is used as a stair well, even if such stair well has a very small plan area. For this purpose a corresponding vertical offset between floor sections is provided in the stair well and an intermediate landing is provided for each upper floor. When in such case four apartments are provided on each floor, two apartments can be reached from the main landing and the other two apartments from the intermediate landing.

Owing to the provision of upper floors having vertically offset sections, the building can be erected to great advantage on a hillside although the concept may also be used on flat ground.

The residential building in accordance with the invention may be provided with various kinds of roofs, such as flat roofs, pent roofs, gable roofs, hipped roofs, etc. The orientation of a gable roof or pent roof may be parallel or at right angles to the axes of the plan form.

It will be understood that the square cell can be used as a stair well only in multistoried buildings. In a single-storied building the cell may be used e.g., as a hall, from which the surrounding rooms can be conveniently reached. Whereas the cell may adjoin an outer wall of the building, the square cell is preferably spaced from such outer walls in such a manner that the distance from each outer wall to the vertical plane in which the nearest parallel side of the cell is disposed does not exceed three times the grid line spacing. That limitation is suitably complied with also in relatively large residential buildings which comprise a plurality of cells, which are juxtaposed in the plan form, and the axes associated with said cells.

Additional advantages are afforded by the use of the cell as a stair well, which is preferably spaced from the outer walls of the building. The walls or posts defining the sides of the stair well may well be used to carry loads inside the building. Besides, such stair well can be used for the ventilation, heating, cooling and lighting of the building. Light and air can be supplied to the stair well through glass windows provided in the roof or in a step wall which defines the stair well cell and separates two vertically offset roof sections. Radiant heat from the sun may be supplied directly into the stair well through stair well windows provided in such step wall. A heat accumulator may be provided at the lower end of the stair well and heat from said heat accumulator may be supplied through the stair well to the adjoining rooms or apartments. The heat accumulator may consist, e.g., of packed pebbles, which are disposed under the floor of the stair well and which may be heated, e.g., by solar heat collectors provided on the roof. In summer, the stair well windows installed in the step wall between vertically offset roof sections may be opened to ventilate the stair well and through the stair well the adjoining rooms and such ventilation may be promoted by a chimney effected produced by the stair well.

The step wall extending along an axis may form part of a wall which separates two apartments. If such step wall is disposed within one apartment, the vertically offset floor sections will preferably be connected by an intermediate stair, which has in a plan view a length that is equal to one grid line spacing. In that case, the vertical offset may be used for architectural purposes, e.g., to divide a large living room into two parts. The vertical offset has suitably a height of about 95 cm, which is about one-third of the usual heigt of a story.

The advantages of the residential building in accordance with the invention will be particularly obtained if the grid line spacing is between 160 cm and 200 cm and preferably about 180 cm.

Illustrative embodiments of the invention are diagrammatically shown on the accompanying drawings and will now be explained.

Figure 2:
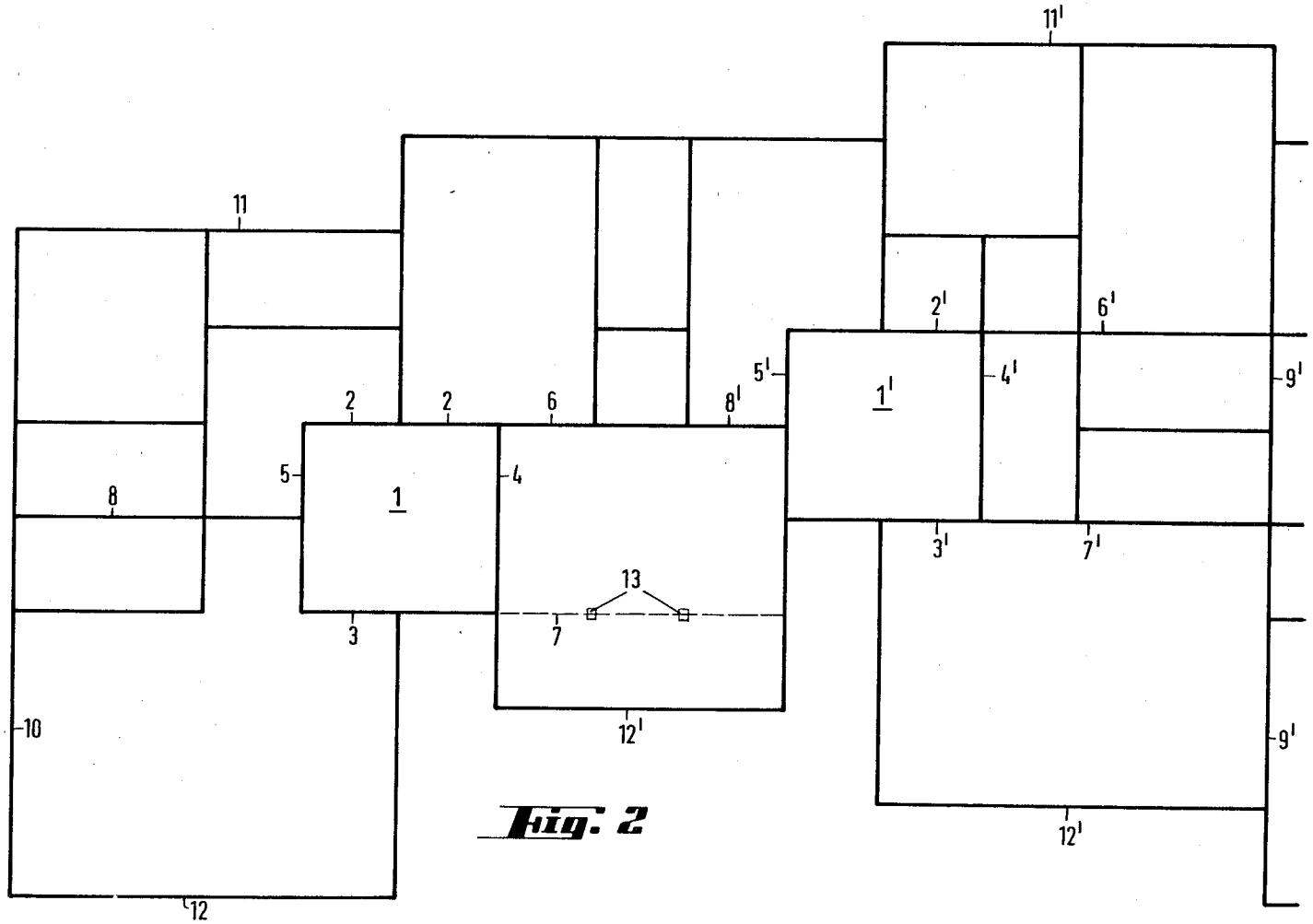

In the drawings,

FIG. 1 is a simplified plan view showing a residential building embodying the essential features of the invention, FIG. 2 is a highly simplified plan view showing a building which consists of a plurality of sections, each of which has a square cell, three axes, and a wall structure.

Figure 3:
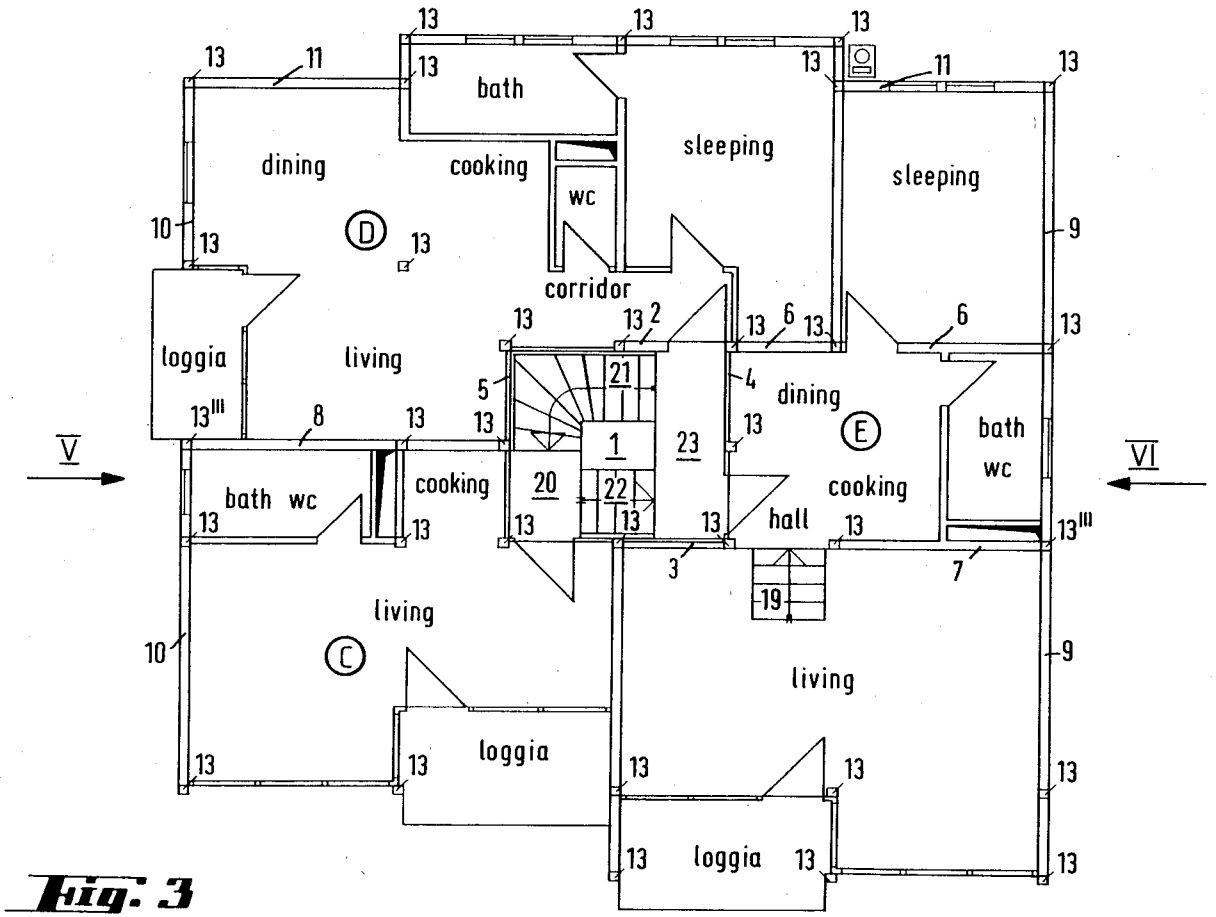
Figure 4:
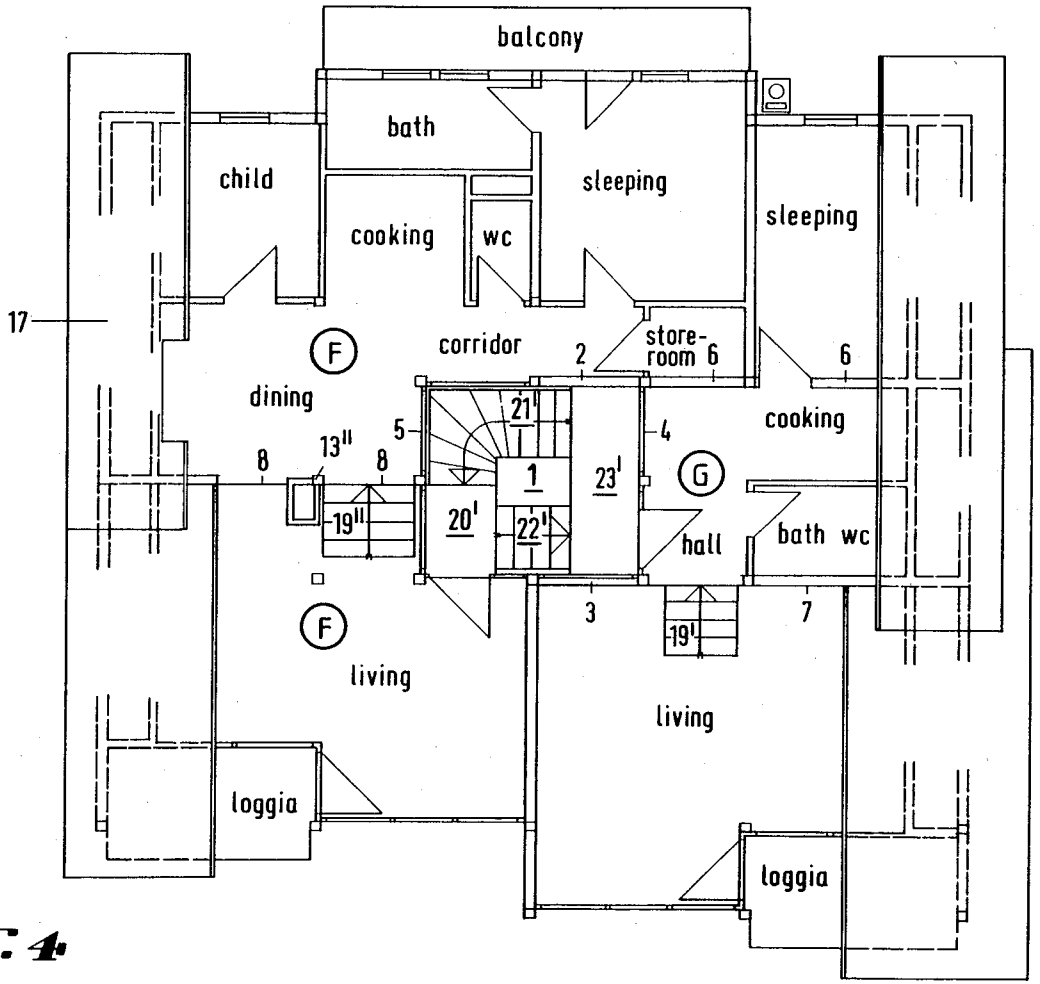
Figure 5:
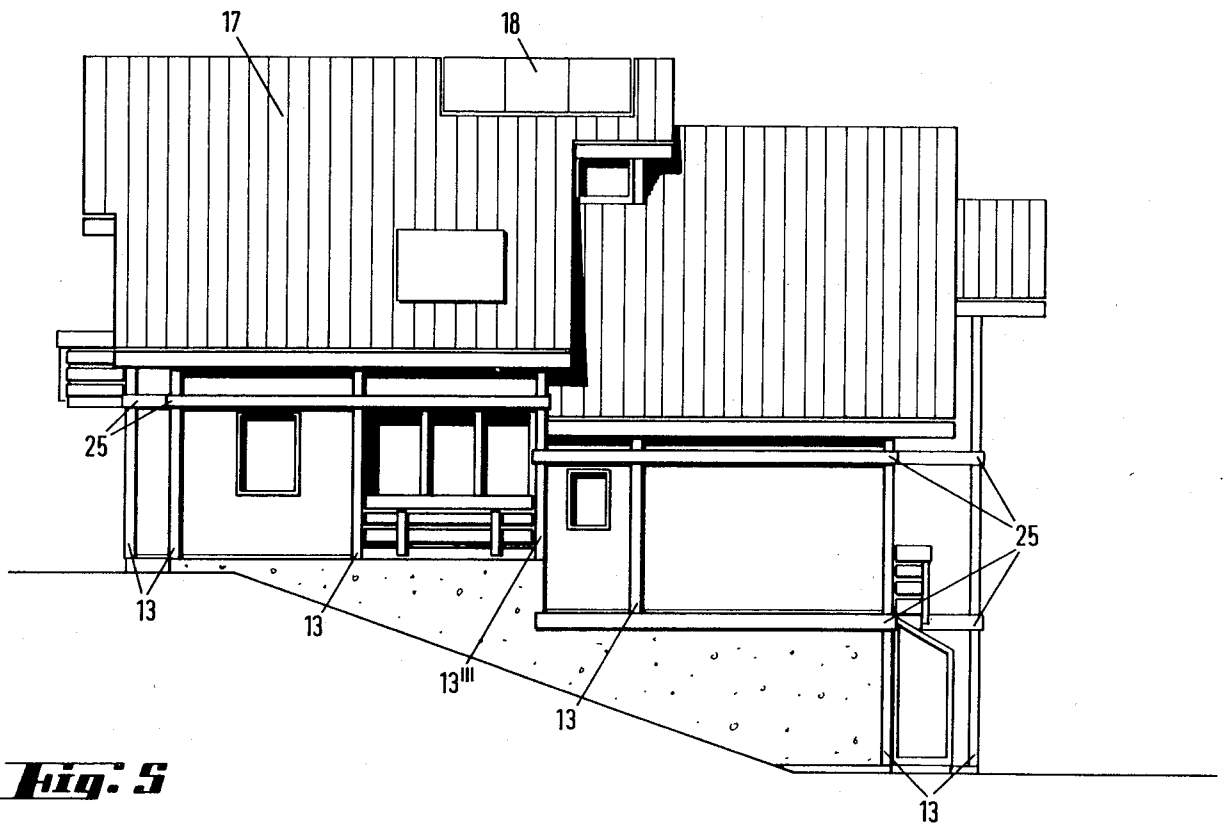
Figure 6:
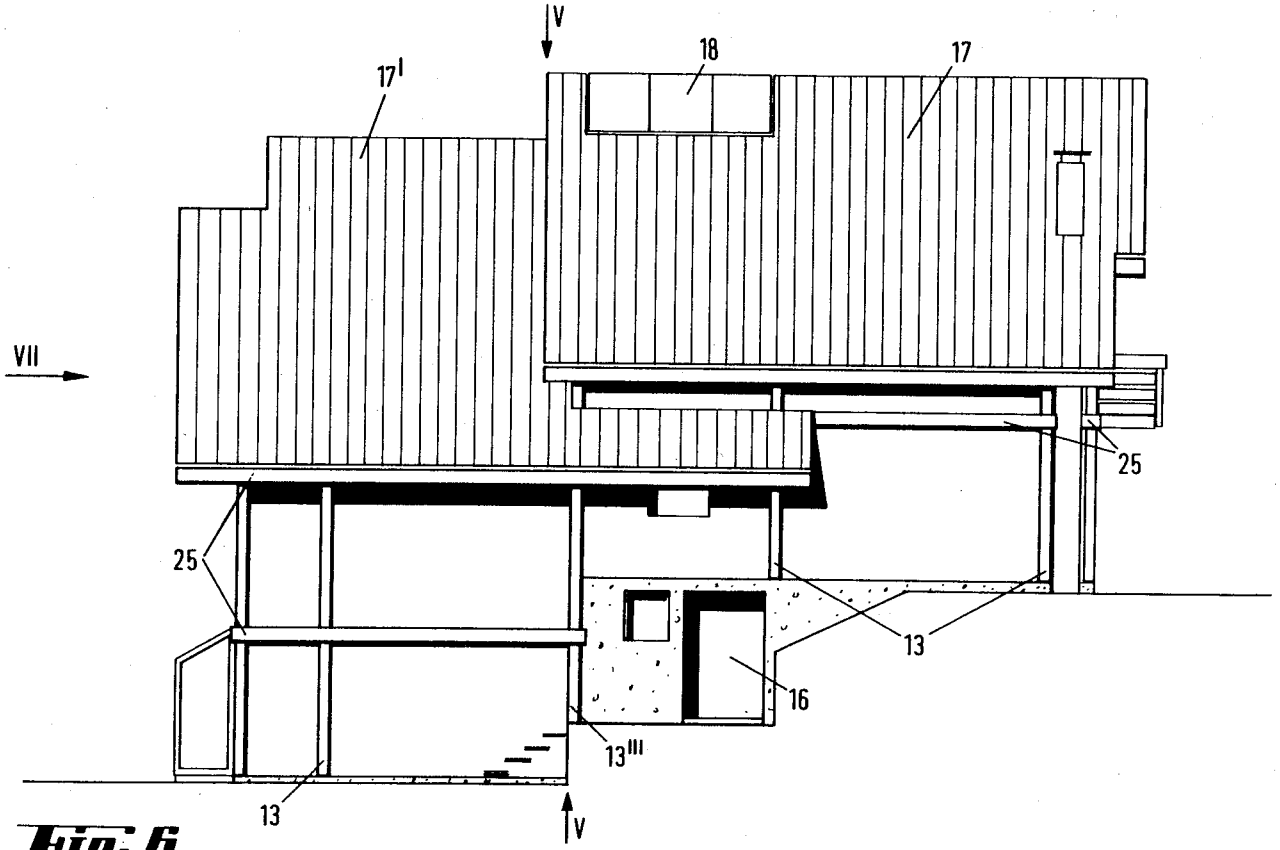
Figure 7:
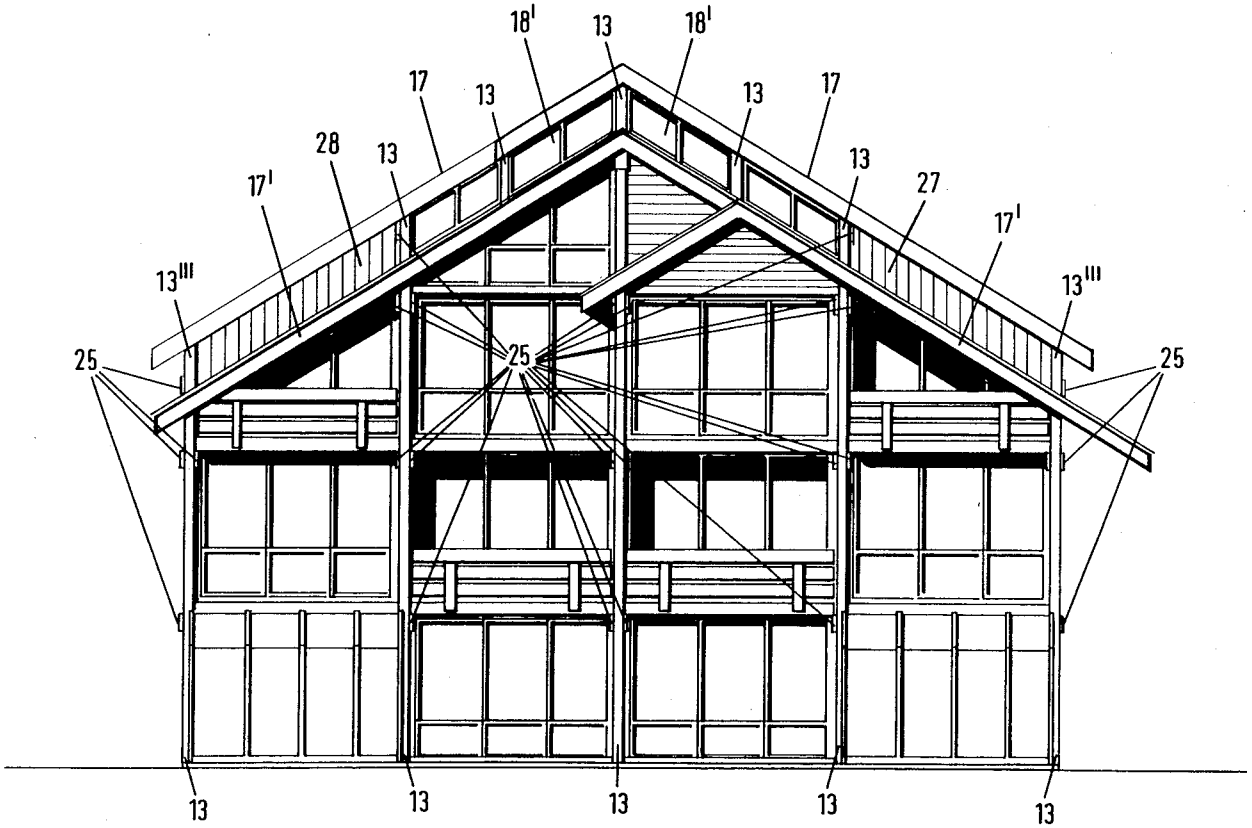

FIG. 3 is a more detailed plan view of the ground floor of a residential building which has been erected on a hillside and comprises three apartments in one story, FIG. 4 is a plan view showing the attic story of the building shown in FIG. 3, FIG. 5 is a side elevation taken in the direction of the arrow V shown in FIG. 3, FIG. 6 is a side elevation taken in the direction of the arrow VI in FIG. 3 and FIG. 7 is a side elevation showing the southern side of the building shown in FIG. 6 (arrow VII).

In all figures of the drawings, identical or corresponding elements are designated by the same reference numbers, with or without prime (').

The plan form shown in FIG. 1 is based on a square-field grid plan having a grid line spacing A=180 cm. The stair well constitutes a central square cell 1 having a side length 2A. That cell 1 is surrounded by the other rooms which are provided in a given story of the building. Two axes 6 and 7 are aligned with two mutually opposite side walls 2 and 3 defining the cell 1. From one of those two side walls 4 and 5 of the cell which are at right angles to said axes, namely, from the side wall 4, said axes 6 and 7 extend as far as to the outer wall 9 of the building. A third axis 8 extends from the center of the side wall 5 of the cell 1 to the opposite outer wall 10 of the building. The side wall 5 is the other of said two side walls which are at right angles to said axes.

The floor comprises floor sections which are vertically offset along the axes 7 and 8 and along that half of the side wall 5 of the cell 1 which connects said axes 7 and 8. As a result, the level of that floor section which is disposed between the axes 7 and 8 and the outer wall 12 is about 95 cm below the level of that floor section which is disposed between the axes 7 and 8 and the outer wall 11.

The residential areas can be reached from the stair well from a main landing on one of said levels and from an intermediate landing on the other level.

The building having the illustrated plan form is intended to be erected as a building having a timber skeleton. The static loads are mainly taken up by posts 13, each of which is disposed at an intersection of grid lines. For this reason, a total of eight posts 13, which are spaced by the grid line spacing A, are disposed in the side walls 2 to 5 of the cell 1. The posts which are remote from the cell 1 have a larger spacing, which in the outer walls 9, 11, and 12 is equal to 2A whereas the posts in the outer wall 10 are spaced different distances A, 2A and 3A apart, and the posts in the inner area between the outer walls 9 to 12 and the side walls 2 to 5 of the cell have a spacing of A, 2A or 3A, as may be required.

Walls may extend along the axes 6, 7 and 8, although this is not necessary. In the plan form shown in FIG. 1, the axes 7 and 8 are defined by walls whereas the axis 6 is formed by a wall only where said axis coincides with the side wall 2 of the cell 1. The remainder of the axis 6 contains only a post 13'.

The distance from the cell 1 to each outer wall 9 or 10 is three times the grid line spacing A and the distance from the cell 1 to each of the remaining side walls 11 and 12 is twice the grid line spacing A.

The plan form of the residential building may be enlarged as desired beyond the area which is illustrated. In that case an outer wall may constitute a partition wall, such as is indicated by dotted lines in FIG. 1 for the walls 9 and 11, and the axes 6 and 7 may terminate at the wall 9, which defines the end of a section of the building. The basic pattern of the adjoining section of the building again comprises a square cell 1, three axes 6 to 8 and a vertical step wall structure.

It is apparent from FIG. 2 how a plurality of building sections comprising each a square cell 1 or 18, three axes 6 to 8 or 6' to 8' and a vertical step wall structure may be combined. The axes 6 to 8 and the axes 6' to 8' are parallel but are not aligned. The two building sections which are shown are so nested that the axis 6 of the left-hand section of the building is aligned with the axis 8' of the right-hand section of the building. As is indicated by broken lines, that right-hand section is adjoined on the right by an additional section of the building. The axes in both sections of the building are defined by walls, with the exception of the axis 7 in the left-hand section of the building. Only two posts 13 are disposed in said axis 7. Posts which are included in walls are not shown on the drawing.

The vertical step wall structure extends along the axis 8, the side walls 5 and 2 of the cell 1, the axis 6, the side walls 5' and 2' and along the axis 6' and might alternatively extend along the axis 8, the side walls 5 and 2 of the cell 1, the axis 6, the side walls 5' and 3' and the axis 7'. The floor level between said step wall structure and the outer walls 11, 11' is about 90 cm above or below the floor level between that step wall structure and the outer walls 12, 12'.

The residential building shown in FIGS. 3 to 6 has a timber skeleton and has been erected on a hillside plot. The building comprises a basement floor, which extends in part on the ground level, a ground floor, shown in FIG. 3, and an attic floor, which is shown in FIG. 4 and has been provided with rooms in part of its area. The building is based on a grid plan having a grid line spacing A = 180 cm. It comprises three apartments C, D and E on its ground floor and two apartments F and G on its attic floor. Because the building has been erected on a hillside, two additional apartments having the same plan form as the apartments C and D may be accommodated under the latter.

The stair well 1 is accessible from the the basement floor through a door 16 and provides access to all apartments. The stair well is centrally disposed and rises as far as to the gable roof 17, 17' and is directly lighted and ventilated through roof windows 18 and through windows 18' which are shown in FIG. 7 and provided in the outer walls 27 and 28, which constitute step walls between the higher roof section 17 and the lower roof section 17'.

On the ground floor, the apartments C and D are separated by the intermediate axis 8. The two other axes 6 and 7 are disposed in the large apartment E. The vertical step wall structure extends along the axis 8, the stair well walls 5 and 3 and the axis 7, which in the apartment E separates a living zone and a dining zone. The living zone is 95 cm below the dining zone and is connected to the latter by a flight of five steps. The apartment C is on the same level as the living zone of apartment E.

The stair rising from the basement floor is devided by an intermediate landing 20 into a longer, helical section 21 of ten steps and a straight, short section 22 having five steps. The small intermediate landing 20 provides access to the apartment C. The two other apartments D and E can be reached from the main landing 23.

The stair in the attic story is divided in the same manner into a short section 21' and a long section 22' by an intermediate landing 20', from which the apartment F is accessible. The apartment G can be reached from the main landing 23'.

The vertical step wall structure extends in the attic story on the same baseline as on the ground floor. Just as in the apartment E, the lower living zone and the dining zone of the apartment G are connected by a stair 19' of five steps. But in apartment F there is no wall extending along the intermediate axis 8, which contains only a post 13''. An additional intermediate stair 19'' is provided between the post 13'' and the adjacent wall 5 of the stair well and connects the lower living zone and the dining zone in the apartment F.

The floor of the stair well 1 may be constituted by a heat accumulator, which may consist of packed pebbles, which may be heated by solar heat collectors. Such collectors may be installed, e.g., on the hillside. Because all apartments have access to the centrally disposed stair well 1, heat may be withdrawn from the heat accumulator through the stair well 1, e.g., by suitable air ducts between the apartments and the stair well. In summer, air can be supplied to and withdrawn from the building through the roof windows 18 over the stair well and also through the windows 18', which are provided in the step wall and which are partly contiguous to the stair wall 1 and partly to the rooms adjoining said step wall. In winter, the windows 18' installed in the step wall contribute in a desirable manner to a direct lighting and heating of the rear rooms of the attic story.

An important advantage afforded by the vertical step wall structure is apparent from the two side elevations of the building shown in FIGS. 5 and 6. The horizontal timbers 25 extending at right angles to the axes 6 to 8 need not extend throughout the length of the building but it is sufficient for them to extend from the corners of the building to the step wall V. Owing to the offset, the horizontal timbers 25 can overlap each other at the posts 14''' disposed in the step wall V.

I claim:

1. In a residential building of the type having a timber skeleton comprising at least one ceiling structure defining a top of a story, and walls, which extend at right angles to each other and are arranged in accordance with a square-field grid plan having a first set of parallel grid lines and a second set of parallel grid lines extending at right angles to those of said first set, the grid lines of both of said sets having the same predetermined grid line spacing and forming grid line intersections, load-carrying means provided on at least some of said grid line intersections, and further comprising in combination, a cell defined by some of said load-carrying means, said cell having a square plan form having a side length that is twice said grid line spacing, first, second and third parallel axes in a plan view of said building defined by positions of some of said load-carrying means, said first and second axes being coincident with two parallel sides of said cell, at least one of said first and second axes extending beyond a first one of the other two sides of said cell, whereas said third axis extends outside said cell from the center of the length of the second one of said other two sides, and a vertical offset between two ceiling structure sections and extending along said third axis and one of said first and second axes, and a step wall structure connecting said two ceiling structure sections.

2. The improvement set forth in claim 1, wherein said ceiling structure constitutes an upper floor.

3. The improvement set forth in claim 1, wherein said ceiling structure constitutes a roof and said step wall structure constitutes outer walls of said building.

4. The improvement set forth in claim 3, wherein windows are installed in said step wall structure which constitutes outer walls of said building.

5. The improvement set forth in claim 4, wherein said windows in said step wall structure face south.

6. The improvement set forth in claim 4 as applied to a building having at least one upper floor, wherein said upper floor consists of two floor sections, which are vertically spaced apart and a step wall structure connects said two floor sections and is vertically aligned with said step wall structure which constitutes outer walls of said building.

7. The improvement set forth in claim 6 as applied to a building having a stair well leading to said upper floor, wherein said stair well defines said cell, said step wall structure which constitutes said outer walls of said building is contiguous to said stair well, and windows which are contiguous to said stair well and adapted to be opened are installed in said outer walls of said building.

8. The improvement set forth in claim 1 as applied to a building having an upper floor and a stair well leading to said upper floor, wherein said stair well defines said cell and said upper floor is constituted by said ceiling structure.

9. The improvement set forth in claim 8 as applied to a residential building having a roof and glazed windows, which are installed in said roof and contiguous to said stair well and adapted to be opened.

10. The improvement set forth in claim 8, wherein in a heat accumulator is provided at the lower end of the stair well.

11. The improvement set forth in claim 10, wherein said stair well has a floor which constitues the top of said heat accumulator.

12. The improvement set forth in claim 8 as applied to a residential building having on said upper floor at least one apartment, wherein said upper floor has two vertically offset floor sections, which are contiguous to said apartment, said step wall structure comprises a step wall which connects said two floor sections and extends along one of said axes, and an intermediate stair having in plan view a length that is equal to said grid line spacing is provided in said apartment between said two vertically spaced floor sections.

13. The improvement set forth in claim 1, wherein said load-carrying means comprise posts disposed on any of said axes and spaced apart along said axis by not more than twice said grid line spacing A and additional posts are provided on grid line intersections which are spaced from said axes, said additional posts being spaced apart by not more than three times said grid line spacing.

14. The improvement set forth in claim 13, wherein said sides of said cell are defined by eight of said posts, which are spaced apart by said grid line spacing.

15. The improvement set forth in claim 1, wherein said ceiling structure sections are vertically spaced apart by about one-third of the height of a story.

16. The improvement set forth in claim 1, wherein said ceiling structure sections are vertically spaced apart by about 95 centimeters.

17. The improvement set forth in claim 1, wherein said grid line spacing is 160 to 200 centimeters.

18. The improvement set forth in claim 1, wherein said grid line spacing is about 180 centimeters.

19. The improvement set forth in claim 1 as applied to a building having outer walls, wherein each of said sides of said cell is contained in a vertical plane which is spaced by no more than three times said grid line spacing from the nearest of said outer walls.

20. The improvement set forth in claim 1 as applied to a residential building having mutually opposite, first and second outer walls and having a timber skeleton which comprises horizontal timbers extending from said first and second outer walls, wherein said step wall structure comprises a step wall which is spaced from said first and second outer walls, said load-carrying means comprise posts adjacent to said step wall, and said horizontal timbers comprise a first set of timbers which extend from said first outer wall and are secured to said posts, and a second set of horizontal timbers which extend from said second outer wall and are secured to said posts and are vertically offset from and overlap the timbers of said first set in a plan view adjacent to said posts.

* * * * *